United States Patent [19]

Welch

[11] 4,356,600

[45] Nov. 2, 1982

[54] BAG CLOSURE DEVICE

[76] Inventor: George A. Welch, 602 Danforth Pl., Fayetteville, N.C. 28303

[21] Appl. No.: 180,668

[22] Filed: Aug. 25, 1980

[51] Int. Cl.[3] ..... B65D 77/10; A44B 21/00

[52] U.S. Cl. ..... 24/30.5 R; 24/137 R; 24/252 R

[58] Field of Search ..... 24/30.5 R, 252 R, 137 R, 24/255 R, 255 SL, 260 R, 265 A; 248/316 B

[56] References Cited

U.S. PATENT DOCUMENTS

| | | | |
|---|---|---|---|
| 437,877 | 10/1890 | Truax | 24/252 R |
| 685,974 | 11/1901 | Cote | 24/252 R |
| 1,488,864 | 4/1924 | Canaday | 24/30.5 R |
| 1,590,682 | 6/1926 | Hart | 24/30.5 R |
| 1,878,497 | 9/1932 | Lehr | 24/137 R |
| 2,255,467 | 9/1941 | Kabriel | 24/137 R |
| 2,466,284 | 4/1949 | Stinne | 24/252 R |
| 2,476,635 | 7/1949 | Southwick | 24/252 R |
| 2,597,462 | 5/1952 | Eisenberg | 24/260 R |
| 2,854,717 | 10/1958 | O'Farrell et al. | 24/30.5 R |
| 3,078,367 | 2/1963 | Jackson | 24/252 R |

FOREIGN PATENT DOCUMENTS

| | | | |
|---|---|---|---|
| 659641 | 10/1951 | United Kingdom | 24/137 R |

*Primary Examiner*—Victor N. Sakran
*Attorney, Agent, or Firm*—Mills and Coats

[57] ABSTRACT

The present invention relates to a bag closure device designed especially to be utilized to close bags such as potato chips and cookie bags and the like. The bag closure device of the present invention comprises a torsional spring closure assembly having a mouth that is movable from an open to a closed position with the torsional spring functioning to bias said mouth towards said closed position. Secured within the mouth of said torsional spring closure assembly is a pair of elongated bag closure members that extend outwardly from said mouth in parallel relationship with respect to each other and which are adapted to directly engage an open portion of a bag and to close the same as said torsional spring closure assembly causes the elongated bag closure members to provide a clamping type closing action about the particular bag.

1 Claim, 2 Drawing Figures

BAG CLOSURE DEVICE

FIELD OF INVENTION

The present invention relates to bag closure devices that are separate and independent of a bag, and more particularly to a spring actuated bag closure device of the type that can be clamped about an open portion of a bag to effectively clamp and seal the same.

BACKGROUND OF INVENTION

Most everyone recalls starting to eat potato chips, cookies and other such types of foods from a bag and discovering that the food is old, stale and not fresh due to the bag not being properly closed and sealed. This situation leaves the food less than tasty, and often, most of the food is not eaten and consequently the food is wasted.

It has long been recognized that a bag closure properly sealing such a bag would prevent this undesirable situation and avoid the wasting of food. Bag closures, both separate from the bag and integral therewith, are known in the prior art. For example, see the disclosures in U.S. Pat. Nos. 2,854,717; 1,488,864; and 2,023,919. But bag closures of the prior art have not met with significant success as witnessed by the absence of such in most homes. In part at least, the reason for this lack of acceptance is that bag closures of the prior art have not been simple, inexpensive, and easy and convenient to use. For the most part, the contrary has been true. Specifically, bag closures of the prior art, especially of the attach-on type, have been large, bulky, difficult and inconvenient to handle and use, and have generally been viewed as too expensive to justify.

Incorporating closure means in an existing bag has been attempted in the past but often this incorporation complicates the design of the bag or container to the point that the total packaging is not desirable from a marketing point of view. Moreover, it is difficult to justify the incorporation of closure means into the actual bag since the closure means cannot be used time after time or be used in closing other bags. Further, it is difficult to design such a closure means integrally constructed within a bag at a cost that will not make the total packaging cost prohibited.

Therefore, there is a real need for a bag or closure device that is simple, easy and convenient to use, effective to create an air tight seal, and which can be utilized in conjunction with all types of bags and containers of the bag type, even bags or containers that are used to contain material or articles other than foods.

SUMMARY OF INVENTION

In view of the foregoing, the present invention entails a bag or container closure that is of the type that can be easily and conveniently clamped about the open portion of a bag or container type bag for effectively closing and sealing the same. The bag closure device of the present invention is simple, easy to use, and relatively inexpensive inasmuch as the same comprises a fastening pin type closure that utilizes a torsional spring to form a clothespin type clamp, and which is further provided with a pair of elongated closure members that are spring biased to a closing position and which are designed such that they can be easily clamped and secured about an open bag to effectively close and seal the same.

It is, therefore, an object of the present invention to provide a bag closure device that is relatively simple and inexpensive and which is designed to be attached to a bag or a container type bag for effectively closing and sealing the same.

A further object of the present invention resides in the provision of a bag closure device of the character referred to above that is effective to close and seal all types and sizes of bags and bag type containers and receptacles.

Another object of the present invention resides in the provision of a bag closure device that is sturdy and reliable and which when properly attached to a bag or bag type container results in a tight and sealed closing.

It is a further object of the present invention to provide a bag closure device that is provided with elongated closure means for engaging a substantial portion of a bag to effectively close the same.

Still a further object of the present invention resides in the provision of a bag closure device of the character referred to above wherein the closure device is of a clothespin fastener type provided with a torsional spring for biasing the closure device towards a closed position.

A further object resides in the provision of a bag closure device of the character referred to above that is safe for children to use and which does not have the potential to harm a small child.

Other objects and advantages of the present invention will become apparent from a study of the following description and the accompanying drawings which are merely illustrative of the present invention.

BAG CLOSURE DEVICE

With further reference to the drawings, the bag closure device of the present invention is shown therein and indicated generally by the numeral 10.

Figure 1:
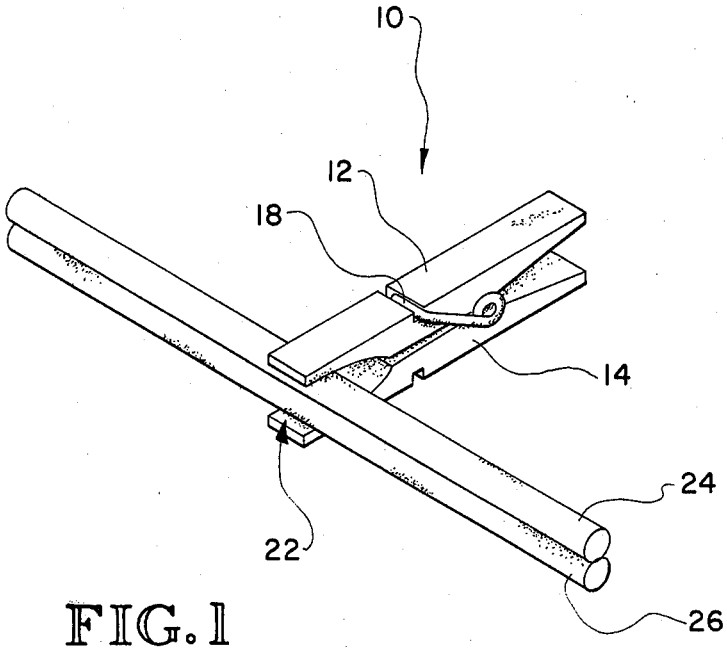
FIG. 1 is a perspective view of the bag closure device of the present invention.
Figure 2:
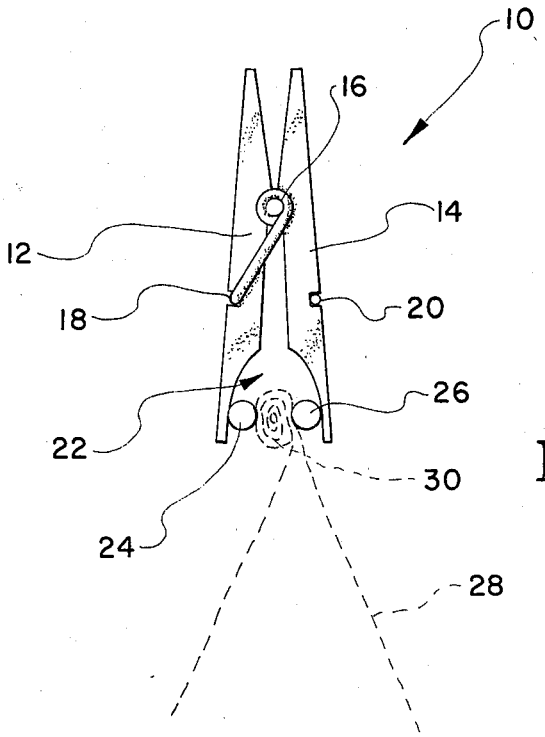
FIG. 2 is a side elevational view of the bag closure device of the present invention shown engaging a rolled up portion of a bag to effectively close the same.

Bag closure device 10, as disclosed in FIGS. 1 and 2, is of a clothespin type fastener including a pair of members or fingers 12 and 14 secured together by an intermediate torsional spring 16. Although not specifically shown, the respective two adjacent members 12 and 14 include inner grooves for receiving the major portion of said torsional spring 16, and are further provided with exterior slots for receiving the two respective ends 18 and 20 of the same torsional spring.

Formed about one end of the bag closure device 10 is a mouth area, indicated generally by the numeral 22. Torsional spring 16 acts to bias this closing end or mouth area 22 towards a closed position. It is appreciated that squeezing pressure applied to the opposite end of the bag closure device 10 will result in the pressure of the torsional spring 16 being overcome and the mouth area 22 being opened.

Secured within mouth 22 is a pair of elongated bag engaging closure members 24 and 26. In the disclosure herein, the closure members 24 and 26 take the form of dowels and as seen in the drawings extend in general face-to-face parallel relationship generally perpendicular to the elongated axes of members 12 and 14. As seen in FIG. 2, the mouth 22 is generally concave shaped for receiving closure members 24 and 26. It is seen that this concaved shape is formed about the entire closing end of the closure device and extends throughout the closing end as formed by members 12 and 14. The concave shape is formed by two areas that are referred to as upper and lower roof areas that are generally arcuately shaped. Note that the concave shape mouth 22 and the respective upper and lower roof areas extend over and beyond members 12 and 14 such that members 12 and 14 lie inwardly within mouth 22.

The operation of bag closure device 10 is specifically illustrated in FIG. 2. Therein a bag is shown in dotted lines and indicated by the numeral 28. An open portion of the bag is formed into a roll 30 and in using the bag closure device 10 of the present invention it is preferable that this roll portion 30 be inserted between bag closure members 24 and 26. It is appreciated that this is done by squeezing the opposite end of members 12 and 14 so as to create an opening between the closure members 24 and 26, and then inserting the roll open portion 30 of the bag 28 into the opening. Once this is done, the pressure being applied to the members 12 and 14 is released and consequently then the torsional spring 16 is operative to bias the mouth area to a closed position causing the closure dowels 24 and 26 to engage and close the bag 28. The pressure of the torsional spring 16 is of sufficient magnitude to create a generally air-tight sealed closure along the rolled portion 30 of the bag.

It is appreciated that the bag closure device 10 of the present invention can be used on all types of bags and that the length of the closure members 24 and 26 can be varied to accommodate any size and type of bag. In addition from the foregoing specification, it is appreciated that the present invention is relatively simple and inexpensive, and can be easily and conveniently used. It has been found that the use of the bag closure device 10 of the present invention is effective to keep food such as potato chips, cookies, crackers and the like fresh for a substantial period of time.

In addition, the bag closure device of the present invention is of a design that can be easily manufactured of wood, plastic or any other suitable material, and is sturdy, dependable, reliable and because of its particular design will have a relatively long life without breaking or wearing out. Therefore, it is believed that the bag closure device of the present invention fills a need in the prior art and that when used will offer significant benefits.

The terms "upper", "lower", "forward", "rearward", etc., have been used herein merely for the convenience of the foregoing specification and in the appended claims to describe the bag closure device and its parts as oriented in the drawings. It is to be understood, however, that these terms are in no way limiting to the invention since the bag closure device may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A spring actuated bag closure device for engaging and closing bags such as potato chips and cookie bags, comprising: a pair of straight, overlying but separate, elongated scissor type members disposed adjacent each other and including spring means operatively interconnected intermediately between a closing end and an opposite finger squeezing end for biasing the closing end of said members towards a closed position and wherein said closing end may be opened by pressing the finger squeezing end together so as to overcome said spring means, and wherein said scissor members are identical and when disposed adjacent each other to form said bag closure device the scissor members include opposed outer flat sides that extend from said closing end to said finger squeezing end; a concave shaped mouth area defined between and interiorly of said scissor members about the closing end thereof, and wherein said mouth includes generally arcuately shaped upper and lower roof areas that form inside portions of said scissor members about the closing end and which extend throughout the closing end of said scissor members; said spring means for holding said scissor type members together and biasing the same for closing including a torsional type clothespin spring interposed between and intermediate the ends of the respective scissor type members and wherein said torsional spring includes two end portions that engage opposite outer areas of the respective scissor type members for biasing said mouth towards a closed position; and a pair of elongated bag closure means secured within said mouth and interiorly of said scissor members such that portions of said scissor type members extend over and beyond said bag closure member for movement therewith, said elongated bag closure members extending substantially from the mouth defined by said scissor type members and generally perpendicular to said scissor members and aligned such that in a closed position, said two elongated closure members move together to grip a substantial length of an open portion of a bag therebetween to close the same.

* * * * *